US007189310B2

(12) United States Patent
Antalffy et al.

(10) Patent No.: US 7,189,310 B2
(45) Date of Patent: Mar. 13, 2007

(54) COKE CHUTE SYSTEMS AND METHODS THEREFOR

(75) Inventors: Leslie P. Antalffy, Houston, TX (US); Samuel A. Martin, Sugarland, TX (US); John W. Oder, Houston, TX (US); Michael B. Knowles, Missouri City, TX (US); George T. West, Houston, TX (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 561 days.

(21) Appl. No.: 10/275,922

(22) PCT Filed: May 8, 2001

(86) PCT No.: PCT/US01/14986

§ 371 (c)(1),
(2), (4) Date: Mar. 31, 2003

(87) PCT Pub. No.: WO01/88062

PCT Pub. Date: Nov. 22, 2001

(65) Prior Publication Data

US 2003/0183500 A1 Oct. 2, 2003

Related U.S. Application Data

(60) Provisional application No. 60/203,986, filed on May 12, 2000.

(51) Int. Cl.
*C10B 25/06* (2006.01)
*C10B 35/00* (2006.01)
*B01D 3/32* (2006.01)

(52) U.S. Cl. ..... 202/239; 202/246; 202/241; 202/245; 202/251; 202/252; 202/262

(58) Field of Classification Search ..... 202/239, 202/246, 241, 245, 242, 244, 251, 252, 262, 202/254

See application file for complete search history.

(56) References Cited

U.S. PATENT DOCUMENTS 4,726,109 A * 2/1988 Malsbury et al. ..... 29/402.08
4,960,358 A * 10/1990 DiGiacomo et al. ..... 414/684.3
5,628,603 A * 5/1997 Antalffy et al. ..... 414/216
5,947,674 A * 9/1999 Malsbury et al. ..... 414/216

* cited by examiner

*Primary Examiner*—N. Bhat
(74) *Attorney, Agent, or Firm*—Rutan & Tucker, LLP

(57) ABSTRACT

Improved coke chute systems (100) include a lock (130) that receives and automatically secures a coke-receiving conduit (110) to a coke vessel after the lock (130) is switched to a closed position. Contemplated systems may further be combined with a horizontally movable coke chute cover, or a cover that is moved by an actuator (114) that lifts and rotates the cover from a first position to a second position.

15 Claims, 3 Drawing Sheets

COKE CHUTE SYSTEMS AND METHODS THEREFOR

This application claims the benefit of U.S. provisional application No. 60/203,986, filed May 12, 2000, incorporated herein by reference in its entirety.

FIELD OF THE INVENTION

The field of the invention is coke chute systems.

BACKGROUND OF THE INVENTION

Many refineries recover valuable products from the heavy residual oil that remains after refining operations are completed. This recovery process, known as delayed coking, produces valuable distillates and coke in one or more large vessels known as coke drums or coking vessels. As used herein, coking drums and vessels are used interchangeably. The operating conditions of delayed coking can be quite severe with normal operating pressures typically in the range from about 15 to about 60 pounds per square inch, and temperatures exceeding 900° F. The product of the delayed coking process is typically a solid coke, which is further processed and cut prior to removal from the coke drum.

Coke recovery begins with a cooling step in which steam and water are introduced into the coke filled vessel to complete the recovery of volatiles and to cool the mass of coke. The vessel is then vented to atmospheric pressure and the top head (typically a 4-foot diameter flange) is unbolted and removed. The vessel is drained and the bottom head (typically a 7-foot diameter flange) is unbolted and removed. A hydraulic coke cutting apparatus is inserted into the vessel to cut the coke. The hydraulically cut coke falls out of the vessel and into a recovery chute to be channeled to a coke pit or pad. Typically, the recovery chute replaces the removed bottom head so that coke falling through the opening created by removal of the bottom head immediately enters the recovery chute.

While ideally all of the coke is captured by the chute and falls through to a coke pit below, in practice there is spillage, and essentially all of the coke is taken to be channeled through to the coke pit as long as no more than a few percent of coke spills onto the floor. However, it is common to have at least some spillage whenever the head is removed, and such spillage is undesirable both because it results in extra work in cleaning up the spillage, and because it poses a threat to workers. Spillage frequently occurs during bottom head removal, and occasionally occurs after head removal but before the coke chute is positioned, especially when shot coke is produced.

Attempts to prevent spillage and to reduce risk to workers have been made, and can generally be categorized as (1) automating the opening or deheading of the coking vessel, and (2) automating the positioning of the coke chute. Automating the deheading of the coking vessel decreases the risk to workers because they need not be present during the initial opening of the vessel when spillage frequently occurs. However, decreasing the risk to workers in this matter does not eliminate the spillage during the opening process. Moreover, if the positioning of the coke chute is not automated, the workers are at risk while positioning the coke chute. Even with an automated chute positioning system, there is a chance that spillage, itself undesirable, will occur prior to the chute being positioned.

Thus, there is a further need for an improved system which will allow coke to be discharged from a coking vessel without placing workers at risk such as by requiring workers to position a coke chute after opening an outlet in the coking vessel, and which will prevent spillage while opening an outlet in the coking vessel.

SUMMARY OF THE INVENTION

The present invention is directed to improved coke chute systems that include a coke receiving conduit coupled to an actuator moving the conduit between a first position and a second position, wherein the conduit is further coupled to a contactor. Contemplated systems further include a lock having an opened position and a closed position, and further comprising a latch, wherein the lock is coupled to a coke vessel, wherein the contactor engages with the latch and secures the conduit relative to the coke vessel when the conduit moves from the first position to the second position and when the lock is in the closed position, and wherein the latch disengages the latch when the lock is switched to the opened position.

In one aspect of the inventive subject matter, the coke-receiving conduit comprises a telescoping coke chute, the actuator comprises a hydraulic cylinder, and the contactor comprises a roller. It is further preferred that the latch may have a curved locking surface that contacts the contactor when the conduit moves from the first position to the second position. In yet further preferred aspects, first position of the conduit is a position in which the conduit is substantially level with an operating platform, and wherein the conduit is fluidly coupled to an opening of the coke vessel in the second position. Preferred switching of the lock comprises manually switching.

In another aspect of the inventive subject matter, a coke chute cover has a frame and a cover coupled to the frame, and a wheel is coupled to the frame, wherein the frame further comprises a guide element, and a bracket coupled to an actuator moves the frame between a first position and a second position, wherein the wheel and the guide element move along the rail, and wherein the frame covers at least part of a flow path of coke between a coke vessel outlet and a coke chute when the frame is in the first position.

In a further aspect of the inventive subject matter, pivoting coke chute cover comprises a cover having a first extension and a second extension, wherein the first extension is coupled to an actuator that lifts and rotates the cover between a first position and a second position, wherein the second extension is coupled to a wheel, and wherein the cover covers at least part of a flow path of coke between a coke vessel outlet and a coke chute when the frame is in the first position. One or both contemplated coke chute covers may be combined with contemplated coke chute system.

Various objects, features, aspects and advantages of the present invention will become more apparent from the following detailed description of preferred embodiments of the invention, along with the accompanying drawings in which like numerals represent like components.

DETAILED DESCRIPTION

It is generally contemplated that improved coke chute systems according to the inventive subject matter may comprise a system, in which a movable coke receiving conduit is releasably secured to a coke drum or coke drum outlet to receive coke after a coking process. Further contemplated improved coke chute systems may include a cover that covers a coke receiving conduit, wherein the cover moves horizontally along a linear or curved path. Contemplated covers may be lifted prior or during the movement.

Figure 1:
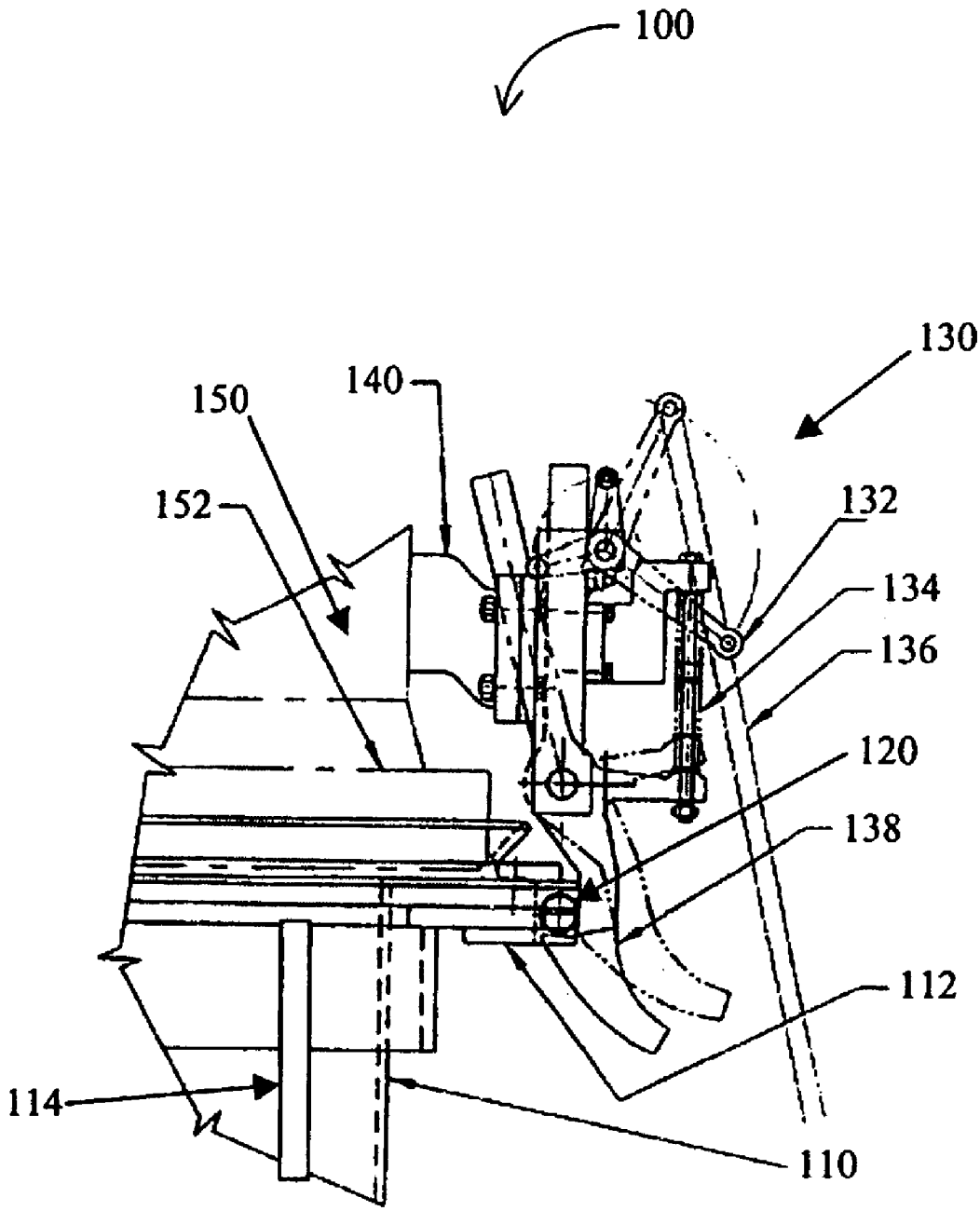
FIG. 1 is a schematic side view of an exemplary coke chute system.

More particularly, as shown in FIG. 1, an improved coke chute system 100 has a coke receiving conduit 110 (here: in a raised position) that further comprises a conduit lift ring 112 which is coupled to a hydraulic actuator 114 to move the coke receiving conduit 110 from a lowered to a raised position. In the raised position, the coke receiving conduit 110 is fluidly coupled to the coke drum or coke drum outlet 150 via a bottom flange 152. A contactor 120 is coupled to the conduit lift ring 112 and engages with the latch 138 of lock 130. The lock 130 further comprises an actuating lever 132 coupled to an actuator handle 136. Latch spring 134 assists in retaining the latch 138 in a closed position. The lock 130 is preferably mounted to the coke drum or coke drum outlet 150 via a mounting bracket 140.

In a preferred aspect of the inventive subject matter, the coke receiving conduit is a telescoping coke receiving conduit, in which the uppermost portion is at or below the upper surface of a platform on which an operator may stand or walk when the coke receiving conduit is in a lowered position. When the telescoping coke receiving conduit is in a raised position, the uppermost portion of the conduit fluidly couples with an outlet of a coke drum or coke drum outlet. While not critical to the inventive subject matter, it is preferred that the uppermost portion of the conduit may further comprise a skirt or funnel-shaped extension which may guide the conduit in a desired position and/or may prevent spillage of coke from the coke drum. It is further preferred that the coke receiving conduit is moved between the lowered and raised position by an automatic mechanism, and particularly contemplated automated mechanisms include hydraulic and/or pneumatic cylinders, cable lifts, raising gear, etc.

In alternative aspects, the coke receiving conduit need not be limited to a telescoping coke receiving conduit, and numerous alternative coke receiving conduits are also contemplated so long as such conduits approximate the coke drum or coke drum outlet from a distal position. The term "distal position" as used herein refers to any position that is at least 30 cm, more typically at least 100 cm, and even more typically at least 150 cm away from the coke drum outlet. For example, where the headspace between the platform and the coke drum outlet is relatively limited, appropriate coke receiving conduits may also move along a horizontal path or along a curved path towards the coke drum outlet. On the other hand, and especially where no operating platform is disposed below the coke drum outlet, suitable conduits may be provided by a coke receiving or storage structure (e.g., rail wagon). Consequently, various actuating mechanism other than hydraulic cylinders are also contemplated. In fact, all reasonable mechanism or modes of moving the coke receiving conduit towards the coke drum outlet are contemplated, including automated methods (supra), manual methods, and any combination thereof. Similarly, suitable coke receiving conduits may or may not have a conduit lift ring. For example, where the conduit is moved by a plurality of steel cables, the ring may be replaced by hooks or loops attached to the conduit. On the other hand, where a crank actuates the conduit, a crank rail may be coupled to the conduit. While it is generally preferred that the conduit is at or below the upper surface of a platform on which an operator may stand or walk when the coke receiving conduit is in a lowered position, numerous alternative positions are also contemplated, including positions above the upper surface of the platform.

With respect to the contactor, it is preferred that the contactor comprises a metal rod that is tangentially coupled to the lift ring (e.g., in a cutout of the lift ring), and that has at least a portion that can engage with the latch of the lock. It is generally preferred that contemplated conduits comprise at least three contactors. However, depending on the size of the conduit and the mode of movement o the conduit, it is contemplated that the number of contactors may vary considerably. For example, where the conduit is rotatably coupled to the coke drum outlet one or two contactors may be appropriate. On the other hand, where the conduit is a telescoping conduit, three or more contactors are preferred. While it is generally preferred that the contactor has a rod-shape, it should be appreciated that numerous alternative shapes and sizes are also suitable, so long as at least a portion of the contactor can contact the latch. For example, appropriate contactors may have a curved shape (e.g., U-shaped), or may comprise a spherical extension (e.g., pear-shaped protrusion). In still further alternative other aspects, the contactor may include a movable element (e.g., a roller or wheel) that may at least in part contact the latch.

In still further preferred aspects of the inventive subject matter, contemplated coke chute systems include a lock that is coupled via a mounting bracket to either the coke drum or a coke drum outlet (which may or may not have a bottom flange). Especially contemplated locks comprise a latch and a latch spring that assists in holding the latch in a closed position. Contemplated locks may further comprise an actuating lever that can be switched (typically by using an actuator handle) between a first and second position, wherein the lever forces the latch into an opened position when the lever is in the first position, and wherein the lever releases the latch into the closed position, when the lever is in the second position (see also FIG. 1, hatched and solid lines).

In a particularly preferred aspect, the latch comprises a curved surface and a locking notch, wherein the latch is rotatably coupled to the lock such that the contactor proceeds along the curved surface to the locking notch as the conduit is raised from a lowered to a raised position. During this "up-latch" process, the latch pivots around a pivot point (which is typically the point of coupling of the latch to the rest of the lock) until the contactor reaches the locking notch on the latch. An optional latch spring on the lock provides counter force to assist retaining close contact between the latch (typically the curved surface and the notch) and the contactor as the contactor moves between the curved surface and the notch. An actuating lever (here: manually operated) may be employed to pivot the latch such that the contactor and the latch disengage (i.e., to switch the lock in an open position). With respect to the latch it should be appreciated that numerous alternative configurations are also appropriate. For example, where appropriate the curved surface may be modified to a straight surface. Furthermore, and especially where redundant safety features are required more than one locking notch may be employed in the latch. In other aspects, the latch spring may be substituted or assisted by various alternative mechanisms, including gas springs, hydraulics, motor assisted mechanisms, etc. Similarly, the actuating lever may be operated by an automatic mechanism (e.g., motor, hydraulics, etc.) where remote operation is particularly desirable. With respect to the number of locks, the same considerations as for the contactors apply.

Thus, it is contemplated that the conduit is secured in a position relative to the coke drum while the lock remains in a locked position. It should further be appreciated that no active opening step is needed in securing the conduit in a position relative to the coke drum. Consequently, a preferred method of operating the improved coke chute system includes a step in which an operator switches the lock in a locked position. In a second step, the conduit is moved towards the coke drum or coke drum outlet and the latch engages with the contactor as the conduit approximates the coke drum or coke drum outlet (thereby securing the conduit is a position relative to the coke drum). In yet another step, the operator switches the lock in the open position (thereby disengaging the contactor and the latch), and the conduit can be lowered from the raised position into a lower position. While it is generally preferred that the lock is manually opened and closed by an operator, alternative modes of operating the coke chute system are also contemplated and include automatic operation of the lock in at least one direction. Similarly, it should be appreciated that the conduit may be raised or lowered manually or automatically.

Figure 2:
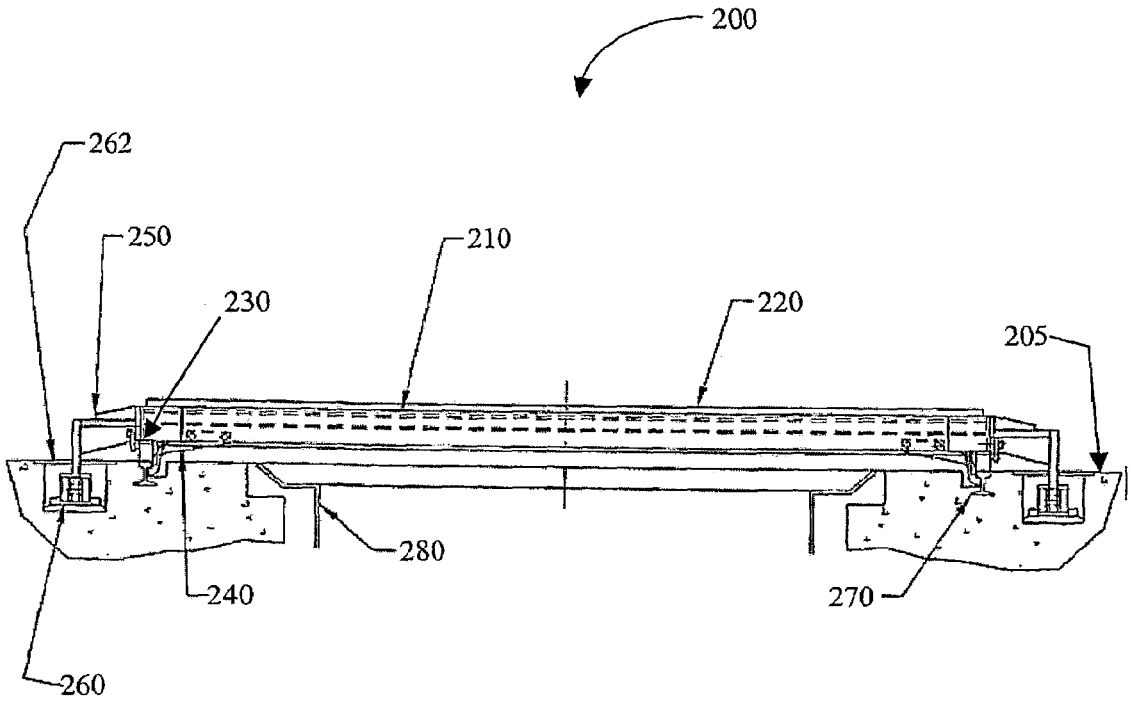
FIG. 2 is a schematic front view of one exemplary coke chute cover.

In still further contemplated aspects of the inventive subject matter, contemplated coke chute systems may further (or additionally) comprise a cover mechanism that covers the coke receiving conduit. Such covers are particularly advantageous the conduit is substantially level with an operating platform when in a lowered position (and wherein the conduit fluidly couples with an opening of the coke vessel in the raised position). FIG. 2 depicts an exemplary cover mechanism 200, in which a coke receiving conduit 280 is in a lowered position and substantially level with a platform 205 on which an operator can stand or walk. The cover mechanism includes a frame 210 onto which a cover 220 is mounted. The frame 210 further comprises a wheel 230 that runs on a rail 270, and the frame may additionally comprise a guide element 240 that guides the frame along the rail 270. The frame 210 is moved in a horizontal direction (substantially parallel to the platform) by an actuator 260, which is disposed within an opening within the platform 205. The actuator is coupled to the frame by bracket 250, and an actuator cover 262 protects the actuator from the operating environment.

While not limiting the inventive subject matter, it is generally preferred that the actuator 260 comprises a hydraulic cylinder that is at least partially disposed in a corresponding cutout or trench within the platform. The actuating force is preferably transmitted via a bracket. However, in further aspects, numerous alternative actuators may be employed, including automatic actuators (e.g., motor operated, pneumatic, crank-driven, etc.) or manual actuators (i.e., actuators in which the actuating force is at least partially provided by an operator). It is further preferred that the frame, cover, guide element, and bracket are manufactured from stainless steel or other, metallic material, however, where appropriate alternative materials may also be employed. Particularly preferred covers comprise a grating, and particularly suitable materials include wood, synthetic polymers, aluminum, and all reasonable combinations thereof. It should further be appreciated that the size of the frame and cover will predominantly depend on the size of the coke receiving conduit and/or the opening through which the coke receiving conduit passes from the lowered position to the raised position. Thus, a typical frame will measure between about 60 cm–300 cm in width and approximately 60 cm–300 cm in length. However, larger covers are also contemplated.

With respect to the rail and actuator it is preferred that at least one of the rail and actuator are at least partially disposed within the platform (e g., in a trench, or partially or completely embedded) in separate locations. However, where appropriate, the rail and the actuator (or alternative mechanism, supra) may also be disposed in a common structure. It should still further be appreciated that where the actuator is disposed within a trench that the trench may be covered by an actuator cover to protect the actuating mechanism from the operating environment. Contemplated cover mechanisms 200 are preferably operated from a remote location using suitable control circuits (e.g., to prevent movement of the cover while an operator stands or walks on the cover.

Figure 3:
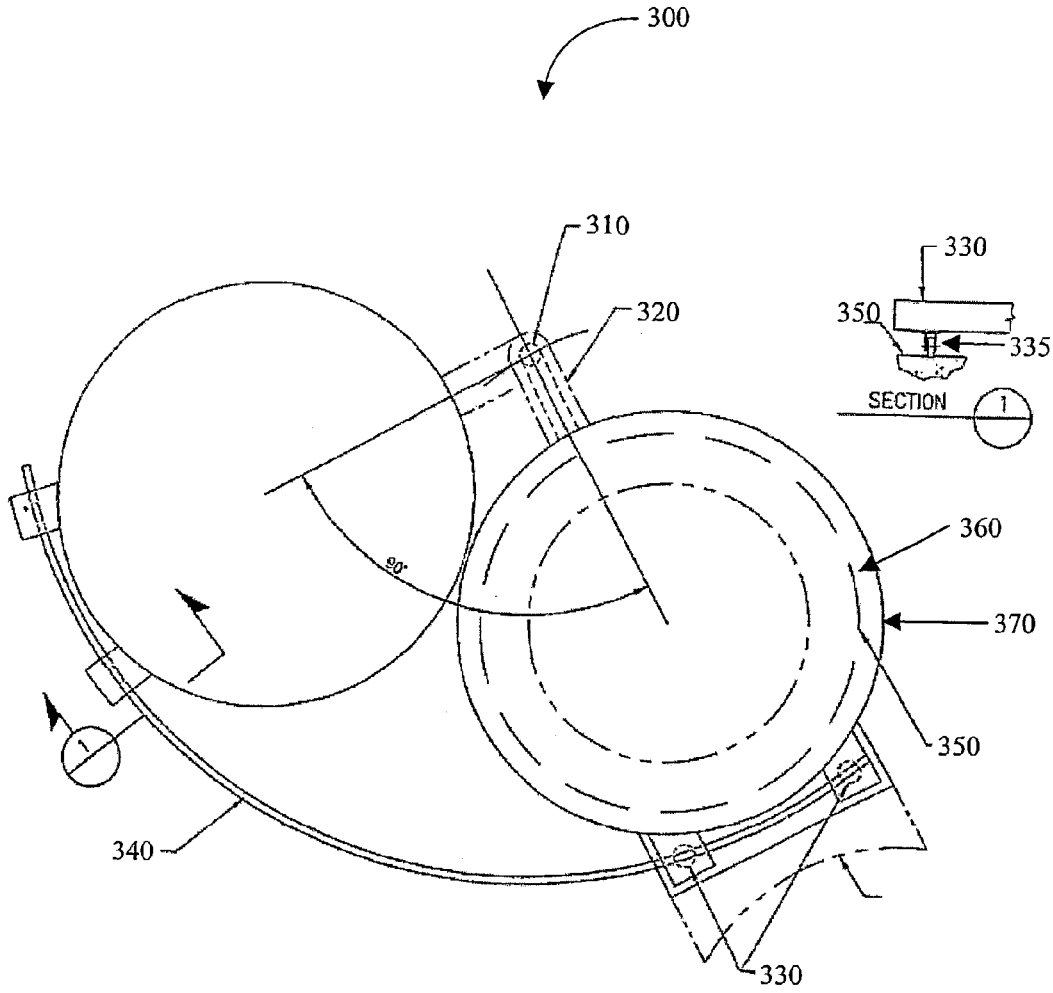
FIG. 3 is a schematic top view of another exemplary coke chute cover.

Alternatively, and especially where it is desired that the cover is substantially flush with the platform, a lifting and rotating actuator mechanism may be employed as depicted in FIG. 3. Here, a cover mechanism 300 has a lifting and rotating actuator 310 that is coupled to a first extension 320 of the frame 370, to which a cover 360 is coupled. A pair of second extensions 330 is coupled to the frame 370 and each of the second extensions 330 has a wheel 335 that rolls on the rail 340 which is at least partially disposed in the platform 350. A coke receiving conduit 350 is disposed underneath the platform when the conduit is in a lowered position.

With respect to the lifting and rotating actuator, it is preferred that the actuator comprises a hydraulic cylinder that lifts the cover sufficiently high such that the lower surface of the cover is above the upper surface of the platform, and such that the cover can be rotated along the rail over the platform. While it is preferred that the rotating movement is automated (e.g., by a motor, hydraulic cylinder, or crank gear), alternative embodiments may employ manual rotation of the cover. Automated rotation may be imparted by rotating the hydraulic cylinder while the cover is in a fixed position relative to the hydraulic cylinder, or by rotatably coupling the hydraulic cylinder to the cover.

It is further contemplated that the first extension is directly attached to the frame and that the platform has corresponding cutouts or openings to accommodate the frame, cover, and the first and second extensions (including the wheels) when the cover is in a closed position (i.e., when the cover is substantially flush with the upper surface of the platform). With respect to the size, shape and numbers of the first extension it should be appreciated that numerous sizes shapes and numbers are suitable so long as the first extension couples the lifting and rotating actuator to the platform and so long as alternative first extensions allow lifting and rotating the frame and cover. Thus, alternative first extensions may comprise one or more steel rods or plates, and may be welded or bolted to the frame or cover. Similarly, the size, shape and numbers of the second extensions may vary considerably and it should be appreciated that numerous sizes shapes and numbers are suitable so long as the second extensions couple the wheels to the frame or cover, and so long as alternative second extensions allow rotating the frame and cover. With respect to material and shape of the frame and cover, the same considerations as described above apply.

Particularly preferred wheels include stainless steel wheels of approximately 5 cm in outer and it is further preferred that each second extension has at least one wheel. However, there are numerous alternative wheels known in the art and all such wheels are considered suitable for use herein as long as the wheel(s) support the cover and allow rotation of the cover along the rail. Consequently, the rail is preferably a steel rail with an upper surface that is flush with the upper surface of the platform. While it is generally preferred that the lifting and rotating mechanism is automated, it should also be appreciated that at least one of the movements may be manually.

In still further preferred aspects of the inventive subject matter, contemplated cover mechanisms (as depicted in FIGS. 2 and 3) may be combined with contemplated coke chute systems (as depicted in FIG. 1) thereby advantageously increasing the safety of operation around coke drums.

Thus, specific embodiments and applications of improved coke chute systems have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A coke chute system comprising:

a coke chute coupled to an actuator that moves the coke chute between a lowered first position and a raised second position, wherein the coke chute is further coupled to a contactor;

a lock with a latch having an open position and a closed position and coupled to a coke vessel;

wherein the contactor engages with the latch in the closed position and automatically secures the coke chute relative to the coke vessel as the coke chute moves from the first position to the second position; and wherein the contactor disengages the latch in the opened position.

2. The system of claim 1 wherein the coke receiving conduit comprises a telescoping coke chute.

3. The system of claim 1 wherein the actuator comprises a hydraulic cylinder.

4. The system of claim 1 wherein the contactor comprises a roller.

5. The system of claim 1 wherein the latch comprises a curved portion that engages with the contactor.

6. The system of claim 5 wherein the curved portion contacts the contactor as the conduit moves from the first position to the second position.

7. The system of claim 1 wherein the first position is a position of the conduit in which the conduit is substantially level with an operating platform, and wherein the second position is a position of the conduit in which the conduit is fluidly coupled with an opening of the coke vessel.

8. The system of claim 1 wherein switching of the lock comprises manually switching the lock from the opened position to the closed position.

9. The system of claim 1 further comprising the coke chute cover comprising a frame and coke chute cover coupled to the frame, wherein the coke chute cover is a structure other than a coke vessel bottom head; a wheel coupled to the frame, wherein the frame further comprises a guide element, and a bracket coupled to an actuator that moves the frame between a first position and a second position; and wherein the wheel and the guide element move along a rail, wherein the coke chute cover covers at least part of a flow path of coke between a coke vessel outlet and a coke chute when the frame is in the first position.

10. The system of claim 1 further comprising the coke chute cover comprising a coke chute cover from which extend a first extension and second extension, wherein the first extension is coupled to an actuator that lifts and rotates the coke chute cover between a first position and a second position, and wherein the second extension is coupled to a wheel; and wherein the coke chute cover covers at least part of a flow path of coke between a coke vessel outlet and a coke chute when the cover is in the first position.

11. A coke chute cover comprising:

a frame and a coke chute cover coupled to the frame, wherein the coke chute cover is a structure other than a coke vessel bottom head;

a wheel coupled to the frame, wherein the frame further comprises a guide element, and a bracket coupled to an actuator that moves the frame between a first position and a second position; and wherein the wheel and the guide element move along a rail, and wherein the coke chute cover covers at least part of a flow path of coke between a coke vessel outlet and a coke chute when the frame is in the first position.

12. The coke chute cover of claim 11 wherein the actuator comprises a hydraulic cylinder.

13. The coke chute cover of claim 11 wherein at least one of the rail and the actuator are at least partially disposed within a platform.

14. The coke chute cover of claim 11 wherein the cover comprises a grating.

15. A pivoting coke chute cover comprising:

a coke chute cover from which extend a first extension and a second extension, wherein the first extension is coupled to an actuator that lifts and rotates the coke chute cover between a first position and a second position, and wherein the second extension is coupled to a wheel; and wherein the coke chute cover covers at least part of a flow path of coke between a coke vessel outlet and a coke chute when the cover is in the first position.

* * * * *